US008229880B2

(12) United States Patent
Boulatsel et al.

(10) Patent No.: US 8,229,880 B2
(45) Date of Patent: Jul. 24, 2012

(54) EVALUATION OF ACID FRACTURING TREATMENTS IN AN OILFIELD

(75) Inventors: Alexandre Boulatsel, Aberdeen (GB); Matteo Giovannoli, Vienna (AT)

(73) Assignee: Schlumberger Technology Corporation, Sugar Land, TX (US)

( * ) Notice: Subject to any disclaimer, the term of this patent is extended or adjusted under 35 U.S.C. 154(b) by 826 days.

(21) Appl. No.: 12/346,965

(22) Filed: Dec. 31, 2008

(65) Prior Publication Data

US 2009/0182694 A1 Jul. 16, 2009

Related U.S. Application Data

(60) Provisional application No. 61/020,677, filed on Jan. 11, 2008.

(51) Int. Cl.
*G06F 15/00* (2006.01)
*G06F 15/18* (2006.01)

(52) U.S. Cl. ..... 706/62; 703/2; 703/8; 700/117

(58) Field of Classification Search ..... 706/62
See application file for complete search history.

(56) References Cited

U.S. PATENT DOCUMENTS

| | | | | |
|---|---|---|---|---|
| 6,002,985 | A * | 12/1999 | Stephenson | 702/13 |
| 6,745,159 | B1 | 6/2004 | Todd et al. | |
| 2003/0225521 | A1 | 12/2003 | Panga et al. | |
| 2007/0055536 | A1 | 3/2007 | Caveny et al. | |
| 2007/0255545 | A1 | 11/2007 | Pita et al. | |
| 2008/0208782 | A1 * | 8/2008 | Weiss | 706/21 |

OTHER PUBLICATIONS

Identificaion of Parameters Influencing the Response of Gas Storage Wells to Hydraulic Fracturing with the Aid of a Neural Network, 1994, pp. 1-6, McVey.*

* cited by examiner

*Primary Examiner* — Omar Fernandez Rivas
*Assistant Examiner* — Kalpana Bharadwaj
(74) *Attorney, Agent, or Firm* — Colin L. Wier

(57) ABSTRACT

The invention relates to a method for performing acid fracturing operations of an oilfield. The method includes obtaining a plurality of historical data of acid fracturing treatments of the oilfield, generating a neural network based on the plurality of historical data, identifying a stimulation parameter, in the neural network, associated with optimal performance of the acid fracturing treatments, and establishing a best practice procedure for performing the acid fracturing operations based on the stimulation parameter.

19 Claims, 10 Drawing Sheets

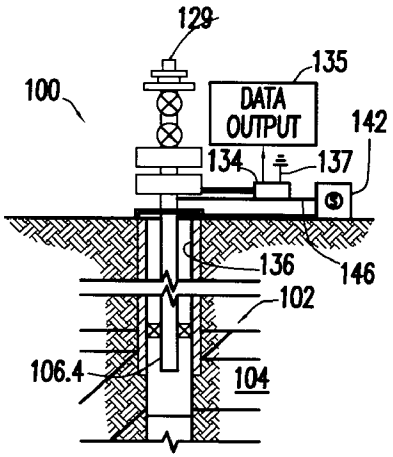
FIG. 1.1
FIG. 1.2
FIG. 1.3
FIG. 1.4
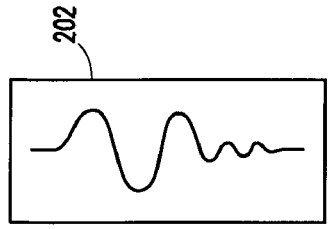
FIG.2.1
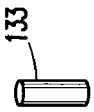
FIG.2.2
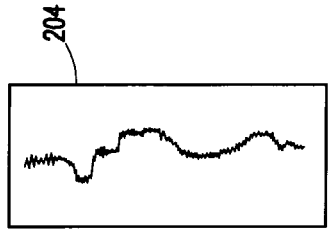
FIG.2.3
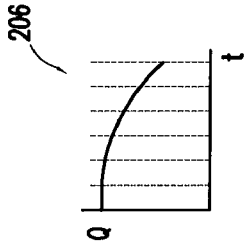
FIG.2.4

FIG.5
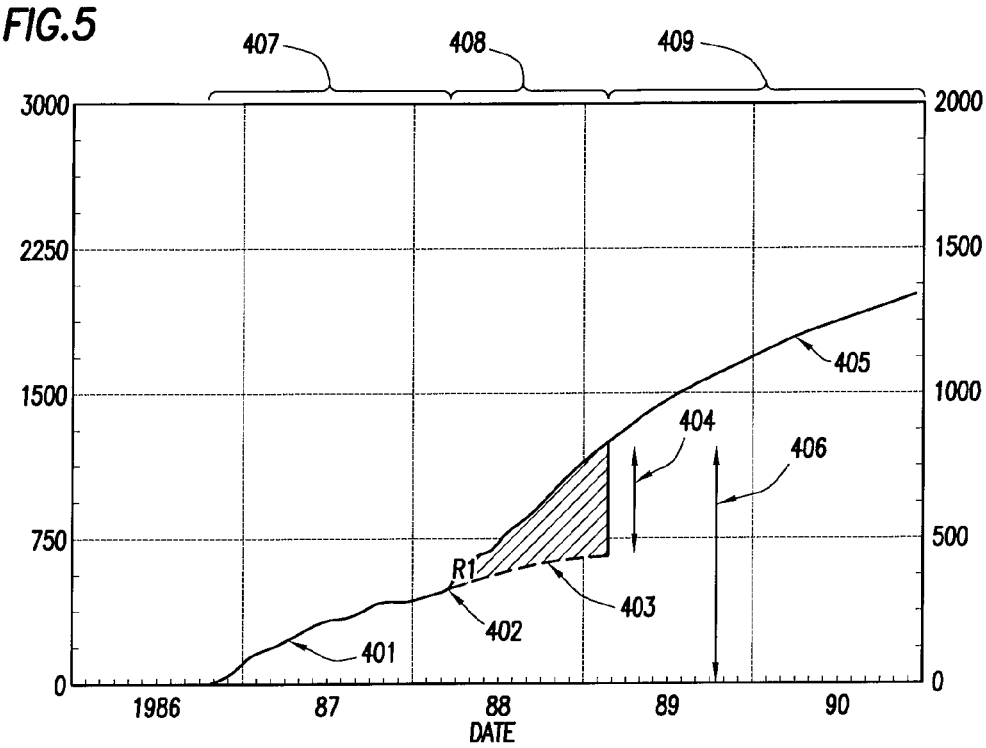
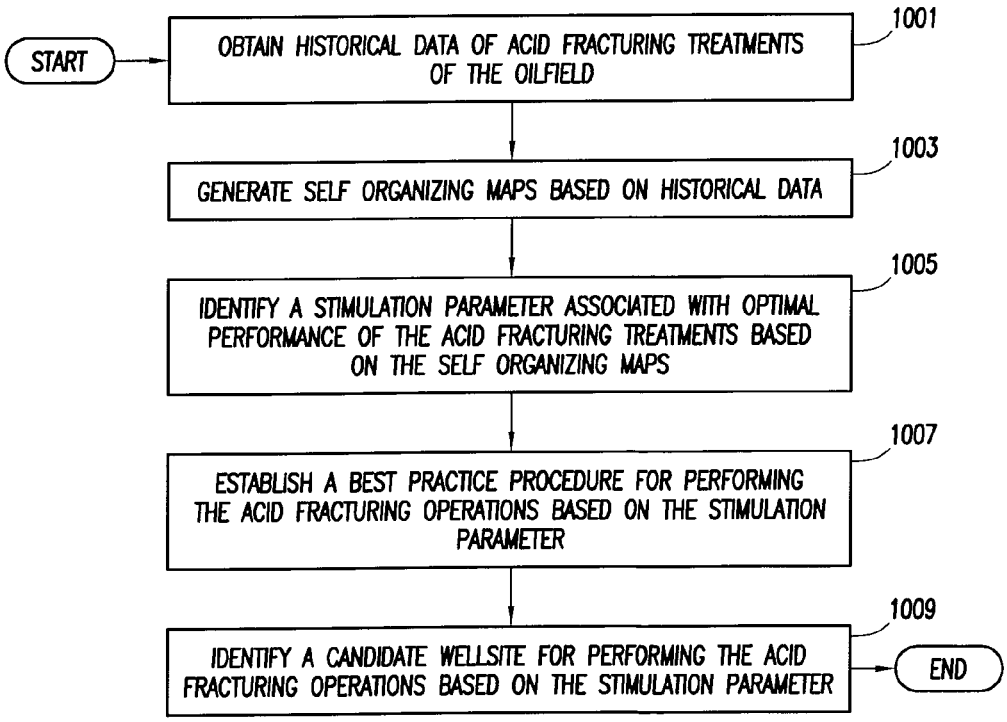
FIG.11

804

Range: Selection

| Component | Value | Std. deviation | Minimum | Maximum |
|---|---|---|---|---|
| acid concentration [-] | 0.243 | 0.049 | 0.172 | 0.280 |
| acid or inhibitor volume [... | 5916.424 | 1548.353 | 4559.438 | 8119.977 |
| cumulative oil gain 3mths... | 277831.790 | 12236.889 | 260715.648 | 289506.862 |
| Cumulative oil post 3mth... | 282966.097 | 17741.405 | 260715.648 | 304140.864 |
| Deviation [-] | 1.000 | -0.000 | 1.000 | 1.000 |
| diverter [STB] | 438.921 | 26.453 | 388.417 | 460.298 |
| gel PAD [STB] | 5624.280 | 700.114 | 4802.060 | 6204.876 |
| job number [-] | 1.170 | 0.202 | 1.000 | 1.452 |
| location [-] | 1.426 | 0.312 | 1.056 | 1.807 |
| maximum rate [-] | 62.796 | 5.820 | 57.059 | 70.863 |
| rate per perforation [-] | 0.369 | 0.058 | 0.322 | 0.464 |
| stages [-] | 28.530 | 3.275 | 24.329 | 31.191 |
| time [-] | 5337.590 | 258.392 | 5101.667 | 5679.280 |
| total length [-] | 5990.779 | 483.670 | 5176.805 | 6492.659 |
| total thickness [ft] | 291.212 | 110.074 | 190.620 | 424.639 |
| total volume [STB] | 14156.426 | 2269.083 | 11864.371 | 17127.589 |
| totperfs [-] | 178.956 | 16.695 | 145.837 | 195.281 |
| Type [-] | 1.294 | 0.360 | 1.000 | 1.807 |
| Years since completion [-] | 0.084 | 0.082 | 0.018 | 0.202 |
| Years since last job [-] | 0.074 | 0.069 | 0.018 | 0.173 |
| acid volume gel pad ratio... | 1.047 | 0.184 | 0.886 | 1.307 |

FIG.9.1

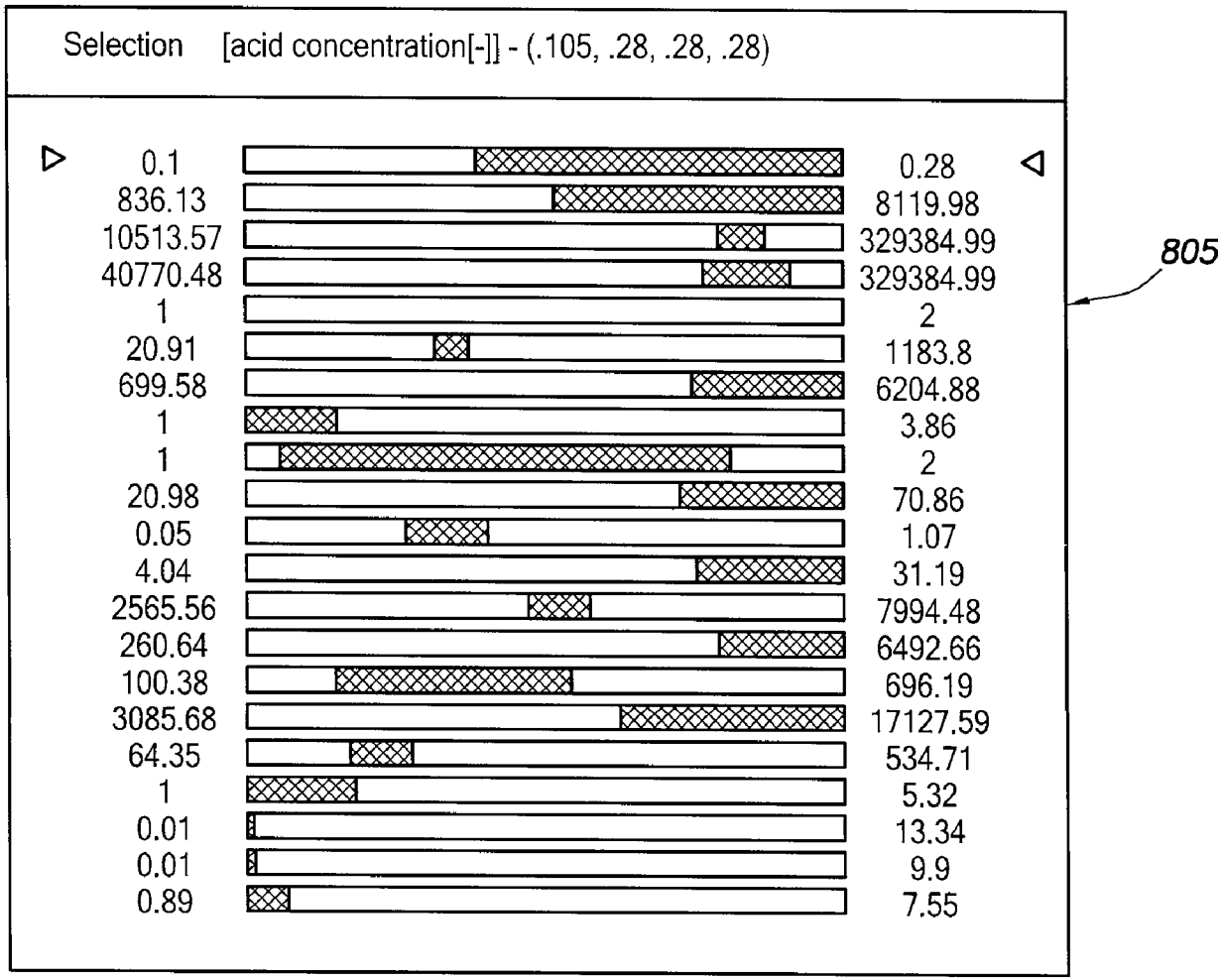
FIG.9.2

EVALUATION OF ACID FRACTURING TREATMENTS IN AN OILFIELD

CROSS REFERENCE TO RELATED APPLICATION

This application claims priority pursuant to 35 U.S.C. §119 (e), to the filing date of U.S. Patent Application Ser. No. 61/020,677 entitled "EVALUATION OF ACID FRACTURING TREATMENTS IN AN OILFIELD," filed on Jan. 11, 2008, which is hereby incorporated by reference in its entirety.

BACKGROUND

During the oilfield operations, data is typically collected for analysis and/or monitoring of the oilfield operations. Such data may include, for example, subterranean formation, equipment, historical and/or other data. Data concerning the subterranean formation is collected using a variety of sources. Such formation data may be static or dynamic. Static data relates to, for example, formation structure and geological stratigraphy that define the geological structures of the subterranean formation. Dynamic data relates to, for example, fluids flowing through the geologic structures of the subterranean formation over time. Such static and/or dynamic data may be collected to learn more about the formations and the valuable assets contained therein.

Data from one or more wellbores may be analyzed to plan or predict various outcomes at a given wellbore. In some cases, the data from neighboring wellbores, or wellbores with similar conditions or equipment may be used to predict how a well will perform. There are usually a large number of variables and large quantities of data to consider in analyzing oilfield operations. It is, therefore, often useful to model the behavior of the oilfield operation to determine the desired course of action. During the ongoing operations, the operating parameters may adjust as oilfield conditions change and new information is received.

One example aspect of the oilfield operations is acid fracturing. Fractures are often induced hydraulically in low-permeability reservoirs to boost hydrocarbon flow. To fracture the rock, a fluid is injected into the rock at a high pressure. As a result, fractures are induced in stages along the length of a wellbore, creating multiple reservoir zones along the wellbore. Data from the fractured wellbore is then collected and analyzed by an oilfield application to characterize the various reservoirs and completions. Proppant, such as sand of a particular size, is sometimes injected into the fracture to keep it open and enhance hydrocarbon flow into the wellbore. Acid treatments may also be used to enhance the fracturing operation. For example, a hydraulic fracturing may be performed in carbonate formations to etch the open faces of induced fractures using a hydrochloric acid treatment. When the treatment is complete and the fracture closes, the etched surface provides a high conductivity path from the reservoir to the wellbore. Other acid commonly used in the treatments includes acetic acid, formic acid, fluoboric acid, or a range of acid types or acid blends.

While hydraulic fracturing using non-reactive fracturing fluid and/or proppant may be modeled using mass conservation equations and continuity equations, acid fracturing mechanisms are not understood with the same level of accuracy due to uncertain downhole conditions of varying geometry associated with acid induced effects as well as parameters that are poorly controlled during typical acid treatments. In addition, production decline of a wellsite is difficult, if not impossible to forecast.

BRIEF DESCRIPTION OF DRAWINGS

FIGS. 1.1-1.4 depict a simplified schematic view of an oilfield in which embodiments of evaluation of acid fracturing treatments can be implemented.

FIGS. 2.1-2.4 are graphical depictions of data collected by the tools of FIGS. 1.1-1.4, respectively in accordance with one or more embodiments.

FIG. 5 depicts an example of production history following an acid fracturing treatment in accordance with one or more embodiments.

FIG. 11 depicts a flow chart of a method in accordance with one or more embodiments.

SUMMARY

Figure 3:
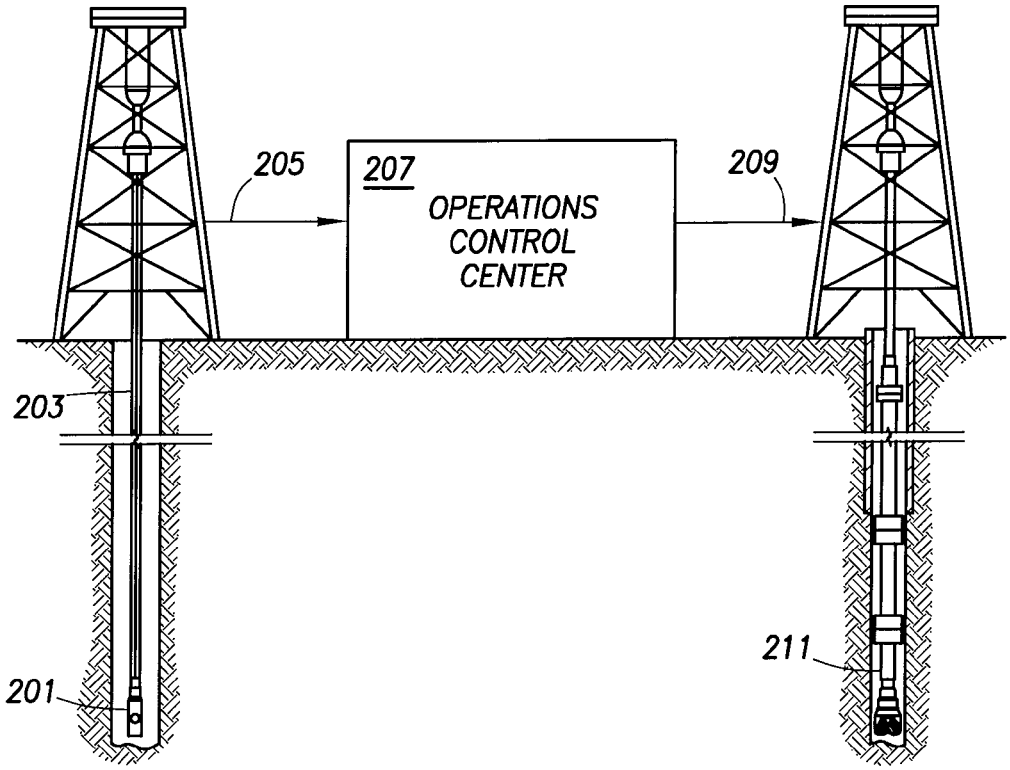
FIG. 3 depicts two wellbores in communication with the operations control center of FIG. in accordance with one or more embodiments 1.

In general, in one aspect, the invention relates to a method for performing acid fracturing operations of an oilfield. The method includes obtaining a plurality of historical data of acid fracturing treatments of the oilfield, generating a neural network based on the plurality of historical data, identifying a stimulation parameter, in the neural network, associated with optimal performance of the acid fracturing treatments, and establishing a best practice procedure for performing the acid fracturing operations based on the stimulation parameter.

Other aspects of the invention will be apparent from the following description and the appended claims.

DETAILED DESCRIPTION

Aspects of evaluation of acid fracturing treatments in an oilfield will now be described in detail with reference to the accompanying figures. Like elements in the various figures are denoted by like reference numerals for consistency.

In the following detailed description of aspects of evaluation of acid fracturing treatments in an oilfield, numerous specific details are set forth in order to provide a more thorough understanding of evaluation of acid fracturing treatments. However, it will be apparent to one of ordinary skill in the art that one or more embodiments may be practiced without these specific details. In other instances, well-known features have not been described in detail to avoid unnecessarily complicating the description.

FIGS. 1.1-1.4 depict simplified, representative, schematic views of an oilfield (100) having subterranean formation (102) containing reservoir (104) therein and depicting various oilfield operations being performed on the oilfield (100). FIG.

1.1 depicts a survey operation being performed by a survey tool, such as seismic truck (106.1) to measure properties of the subterranean formation. The survey operation is a seismic survey operation for producing sound vibrations (112). In FIG. 1.1, one such sound vibration (112) generated by a source (110) and reflects off a plurality of horizons (114) in an earth formation (116). The sound vibration(s) (112) is (are) received in by sensors (S), such as geophone-receivers (118), situated on the earth's surface, and the geophone-receivers receivers (118) produce electrical output signals, referred to as data received (120) in FIG. 1.

In response to the received sound vibration(s) (112) representative of different parameters (such as amplitude and/or frequency) of the sound vibration(s) (112), the geophones (118) produce electrical output signals containing data concerning the subterranean formation. The data received (120) is provided as input data to a computer (122.1) of the seismic truck (106.1), and responsive to the input data, the computer (122.1) generates a seismic data output record (124). The seismic data may be stored, transmitted, or further processed as desired, for example by data reduction.

FIG. 1.2 depicts a drilling operation being performed by drilling tools (106*b*) suspended by a rig (128) and advanced into the subterranean formations (102) to form a wellbore (136). A mud pit (130) is used to draw drilling mud into the drilling tools (106*b*) via flow line (132) for circulating drilling mud through the drilling tools (106*b*), up the wellbore and back to the surface. The drilling tools (106*b*) are advanced into the subterranean formations to reach reservoir (104). Each well may target one or more reservoirs. The drilling tools (106*b*) may be adapted for measuring downhole properties using logging while drilling tools. The logging while drilling tool (106*b*) may also be adapted for taking a core sample (133) as depicted, or removed so that a core sample (133) may be taken using another tool.

A surface unit (134) is used to communicate with the drilling tools (106*b*) and/or offsite operations. The surface unit (134) is capable of communicating with the drilling tools (106*b*) to send commands to the drilling tools, and to receive data therefrom. The surface unit (134) may be provided with computer facilities for receiving, storing, processing, and/or analyzing data from the oilfield (100). The surface unit (134) collects data generated during the drilling operation and produces data output (135) which may be stored or transmitted. Computer facilities, such as those of the surface unit (134), may be positioned at various locations about the oilfield (100) and/or at remote locations.

Sensors (S), such as gauges, may be positioned about the oilfield to collect data relating to various oilfields operations as described previously. As depicted, the sensor (S) is positioned in one or more locations in the drilling tools and/or at the rig to measure drilling parameters, such as weight on bit, torque on bit, pressures, temperatures, flow rates, compositions, rotary speed, and/or other parameters of the oilfield operation. Sensors may also be positioned in one or more locations in the circulating system.

The data gathered by the sensors (S) may be collected by the surface unit (134) and/or other data collection sources for analysis or other processing. The data collected by the sensors (S) may be used alone or in combination with other data. The data may be collected in one or more databases and/or all or transmitted on or offsite. All or select portions of the data may be selectively used for analyzing and/or predicting oilfield operations of the current and/or other wellbores. The data may be may be historical data, real time data, or combinations thereof. The real time data may be used in real time, or stored for later use. The data may also be combined with historical data or other inputs for further analysis. The data may be stored in separate databases, or combined into a single database.

Data outputs from the various sensors (S) positioned about the oilfield may be processed for use. The data may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, and/or reservoir engineering. The reservoir, wellbore, surface and/or process data may be used to perform reservoir, wellbore, geological, and geophysical or other simulations. The data outputs from the oilfield operation may be generated directly from the sensors (S), or after some preprocessing or modeling. These data outputs may act as inputs for further analysis.

The data is collected and stored at the surface unit (134). One or more surface units (134) may be located at the oilfield (100), or connected remotely thereto. The surface unit (134) may be a single unit, or a complex network of units used to perform the necessary data management functions throughout the oilfield (100). The surface unit (134) may be a manual or automatic system. The surface unit (134) may be operated and/or adjusted by a user.

The surface unit (134) may be provided with a transceiver (137) to allow communications between the surface unit (134) and various portions of the oilfield (100) or other locations. The surface unit (134) may also be provided with or functionally connected to one or more controllers for actuating mechanisms at the oilfield (100). The surface unit (134) may then send command signals to the oilfield (100) in response to data received. The surface unit (134) may receive commands via the transceiver or may itself execute commands to the controller. A processor may be provided to analyze the data (locally or remotely) and make the decisions and/or actuate the controller. In this manner, the oilfield (100) may be selectively adjusted based on the data collected. This technique may be used to optimize portions of the oilfield operation, such as controlling drilling, weight on bit, pump rates, or other parameters. These adjustments may be made automatically based on computer protocol, and/or manually by an operator. In some cases, well plans may be adjusted to select optimum operating conditions, or to avoid problems.

FIG. 1.3 depicts a wireline operation being performed by a wireline tool (106*c*) suspended by the rig (128) and into the wellbore (136) of FIG. 1.2. The wireline tool (106*c*) may be adapted for deployment into a wellbore (136) for generating well logs, performing downhole tests and/or collecting samples. The wireline tool (106*c*) may be used to provide another method and apparatus for performing a seismic survey operation. The wireline tool (106*c*) of FIG. 1.3 may, for example, have an explosive, radioactive, electrical, or acoustic energy source (144) that sends and/or receives electrical signals to the surrounding subterranean formations (102) and fluids therein.

The wireline tool (106*c*) may be operatively connected to, for example, the geophones (118) stored in the computer (122.1) of the seismic truck (106.1) of FIG. 1.1. The wireline tool (106*c*) may also provide data to the surface unit (134). The surface unit collects data generated during the wireline operation and produces data output (135) which may be stored or transmitted. The wireline tool (106*c*) may be positioned at various depths in the wellbore (136) to provide a survey or other information relating to the subterranean formation.

Sensors (S), such as gauges, may be positioned about the oilfield to collect data relating to various oilfield operations as described previously. As depicted, the sensor (S) is positioned in the wireline tool to measure downhole parameters that relate to, for example porosity, permeability, fluid composition and/or other parameters of the oilfield operation.

FIG. 1.4 depicts a production operation being performed by a production tool (106*d*) deployed from a production unit or Christmas tree (129) and into the completed wellbore (136) of FIG. 1.3 for drawing fluid from the downhole reservoirs into the surface facilities (142). Fluid flows from reservoir (104) through perforations in the casing (not depicted) and into the production tool (106*d*) in the wellbore (136) and to the surface facilities (142) via a gathering network (146).

Sensors (S), such as gauges, may be positioned about the oilfield to collect data relating to various oilfield operations as described previously. As depicted, the sensor (S) may be positioned in the production tool (106*d*) or associated equipment, such as the Christmas tree, gathering network, surface facilities and/or the production facility, to measure fluid parameters, such as fluid composition, flow rates, pressures, temperatures, and/or other parameters of the production operation.

While simplified wellsite configurations are depicted, it will be appreciated that the oilfield may cover a portion of land, sea, and/or water locations that hosts one or more wellsites. Production may also include injection wells (not depicted) for added recovery. One or more gathering facilities may be operatively connected to one or more of the wellsites. The gathering facilities selectively collect downhole fluids from the wellsite(s).

While FIGS. 1.2-1.4 depict tools used to measure properties of an oilfield (100), it will be appreciated that the tools may be used in connection with non-oilfield operations, such as mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The oilfield configuration in FIGS. 1.1-1.4 is intended to provide a brief description of an example of an oilfield usable with the one or more embodiments. Part, or all, of the oilfield (100) may be on land and/or sea. Also, while a single oilfield measured at a single location is depicted, the evaluation of acid fracturing treatments may be utilized with any combination of one or more oilfields (100), one or more processing facilities, and one or more wellsites.

FIGS. 2.1-2.4 are graphical depictions of examples of data collected by the tools of FIGS. 1.1-1.4, respectively. FIG. 2.1 depicts a seismic trace (202) of the subterranean formation of FIG. 1.1 taken by seismic truck (106.1). The seismic trace may be used to provide data, such as a two-way response over a period of time. FIG. 2.2 depicts a core sample (133) taken by the drilling tools (106*b*). The core sample may be used to provide data, such as a graph of the density, porosity, permeability or other physical property of the core sample (133) over the length of the core. Tests for density and viscosity may be performed on the fluids in the core at varying pressures and temperatures. FIG. 2.3 depicts a well log (204) of the subterranean formation of FIG. 1.3 taken by the wireline tool (106*c*). The wireline log typically provides a resistivity or other measurement of the formations at various depts. FIG. 2.4 depicts a production decline curve or graph (206) of fluid flowing through the subterranean formation of FIG. 1.4 measured at the surface facilities (142). The production decline curve (206) typically provides the production rate Q as a function of time t.

The respective graphs of FIGS. 2.1-2.3 depict examples of static measurements that may describe information about the physical characteristics of the formation and reservoirs contained therein. These measurements may be analyzed to better define the properties of the formation(s) and/or determine the accuracy of the measurements and/or for checking for errors. The plots of each of the respective measurements may be aligned and scaled for comparison and verification of the properties.

FIG. 2.4 depicts an example of a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subterranean formation to determine characteristics thereof. Similar measurements may also be used to measure changes in formation aspects over time.

The surface unit (134) of FIG. 1.3 and the surface facilities (142) of FIG. 1.4 may be referred to as operations control center. FIG. 3 depicts the cooperation of an operations control center (207) with at least two wells. A purpose of the operations control center (207) is to collect data and control a drilling or production operation, for example an acid fracturing treatment operation. Similar to what are depicted in FIGS. 1.2-1.4 and FIG. 3, the down-hole sensors (201) and well-head sensors (203) provide data (i.e., data collected and/or otherwise obtained from the down-hole sensors (201) and/or the well-head sensors (203)). Upon receipt of the information, a first communication link (205) transfers the aforementioned data to the operations control center (207).

The operations control center (207) stores and, in some cases, optionally processes and/or analyzes the data, for example historical data of the acid fracturing treatment operations. In some cases, the operations control center (207) may also generate and transmit control signals via the second communication link (209) to a down-hole apparatus (211). For example, the operations control center (207) may automatically generate control signals using data obtained via communications link (205). In another example, the operations control center (207) may provide information to an operator that may consider the information, and then send control signals as desired. In addition, in some embodiments, the operations control center (207) may also provide feedback to down-hole sensors (201) and/or well-head sensors (203) using data obtained via communications link (205). Although the two wells in FIG. 3 are depicted with above surface and downhole drilling equipments, one skilled in the art will appreciate these depiction may be substituted with production equipments such as acid fracturing equipments.

Figure 4:
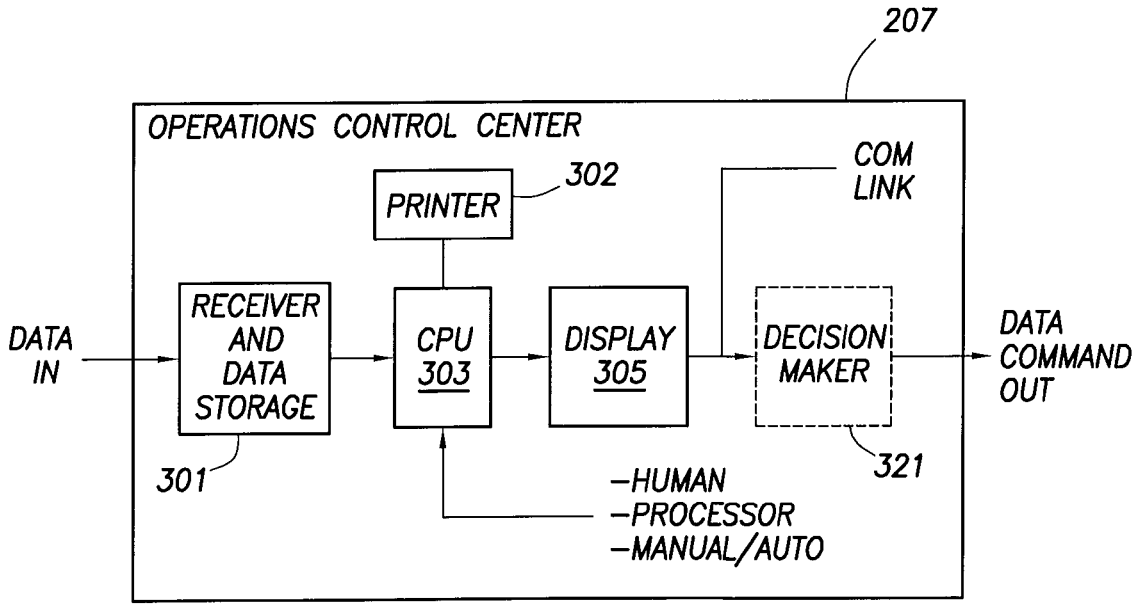
FIG. 4 depicts a detailed view of the operations control center of FIG. 3 in accordance with one or more embodiments.

FIG. 4 depicts the operations control center (207) in more detail. A receiver and data storage (301) corresponds to a device configured to receive and store data, for example, from a sensor (i.e., (201, 203) of FIG. 3) or other components internal and/or external to the operations control center (207).

Receiver and data storage (301) may be implemented, for example, using a magnetic storage device, an optical storage device, a NAND storage device, any combination thereof, etc.

The receiver and data storage (301) may also store software programs (e.g., simulation software) for processing data.

A CPU (303) (e.g., a microprocessor) is configured to process data (e.g., data stored in the receiver and data storage (301)), to store processed data and/or generate commands to operate various oilfield components depicted in FIGS. 1 and 2. In addition, the CPU (303) may operate output devices such as a printer (302), for example, to print out a questionnaire for collecting opinions. The CPU (303) may also operate a display device (305) (e.g., a monitor, etc). A decision-maker (321) may optionally contribute to selecting a work element to be enhanced. For example, the decision-maker (321) may operate a keyboard or mouse (not depicted) to register estimates, such as estimates from analyzing historical data of acid fracturing treatments. The CPU (303) may also store such estimates or rated elements to the receiver and data storage (301).

The approach used in one or more embodiments is a data driven model rather than an analytical model and is based on the collection of large amount of acid fracturing treatments performed in an oilfield field over a wide range of variation of various parameters. For example, historical data are collected from acid fracturing treatments performed at a well over time and/or performed at many wells. The historical data may include stimulation parameters such as treatment parameters (e.g., treatment type such as first completion, re-stimulation, etc., acid volumes, fluids types, stages, rates, etc.), wellbore information parameters (e.g., deviation, perforations number, completed lengths, etc.), reservoir parameters (e.g., reservoir pressure, porosity, permeability, water saturation, etc.), production output (e.g., cumulative oil post treatment, re-stimulation ratio, etc.), or other relevant parameters.

The large amount of data and stimulation parameters can not be analyzed through simple linear relationships since the data and stimulation parameters form an N dimensional space, N being the number of parameters. Self organizing maps may be generated for viewing portions of data in perspective with the entire set. Acid fracturing treatments may then be clustered according to overall similarities viewed from the self organizing maps. It may then be possible to identify the stimulation parameters (e.g., treatment parameters, wellbore parameters, reservoir parameters, etc.) associated with particular acid fracturing treatments that produced the best overall result.

A data driven model may be generated along with the self organizing maps, for example using neural network techniques. A subset of the N parameters may be identified (as governing parameters) that has sufficient influence over the acid fracturing treatment effectiveness, for example based on post treatment, production output. The identified treatment parameters, wellbore parameters, and reservoir parameters may be inputted to the data driven model for comparing to the historical data. The data driven model may then be adjusted and validated based on the comparison. Once validated, the data driven model may be used to establish best practice procedures of acid fracturing treatments. These best practice procedures may be applied to design re-stimulation pumping program for existing wells or completion and pumping programs for a new well. The best practice procedure may focus on the governing parameters (reduced from the subset of N parameters) such that the procedure may be practiced effectively. The validated data driven model may also be used to evaluate wellsites in the oilfield to identify candidates predicted to produce effective results from the acid fracturing treatments.

FIG. 5 depicts an example post acid fracturing treatment production history. The horizontal axis represents the time scale or date. The vertical axis represents cumulative production output of a well under study. Here, solid trace (401) represents cumulative production output during time period (407) prior to an acid fracturing treatment performed at (402). Dashed trace (403) represents the hypothetical scenario of cumulative production output without acid fracturing treatment and is an extrapolation of the solid trace (401) based on analysis of production decline coefficient before the acid fracturing treatment at (402). Solid trace (405) represents cumulative production output during time periods (408) and (409) subsequent to the acid fracturing treatment performed at (402). For example, the vertical axis value (406) represents the cumulative production output subsequent to the acid fracturing treatment at (402) at the end of the time period (408). The difference (404) between the solid trace (405) and the dashed trace (403) represents the cumulative gain of production output subsequent to the acid fracturing treatment at (402) during the time period (408). The time period (408) may be a three month period, a six month period, or other appropriate time period. In the case of a new well with no prior production output, treatment (402) represents an initial stimulation, traces (401) and (403) degenerate to a horizontal line, and cumulative production output (406) equals cumulative gain of production output (404).

Figure 6:
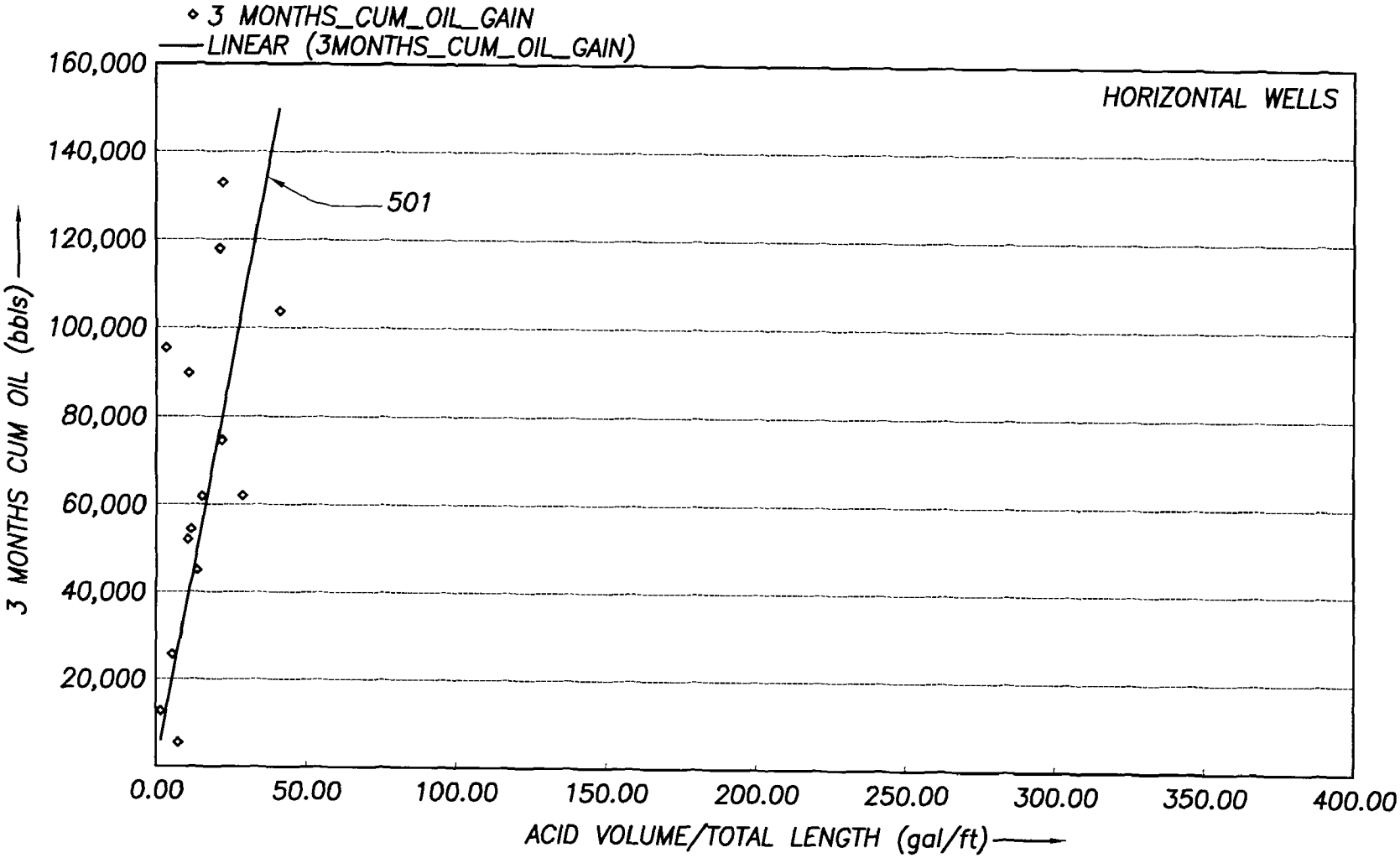
FIGS. 6-7 depict example data plots depicting the influence of acid volume over cumulative gain in acid fracturing treatments in accordance with one or more embodiments.
Figure 7:
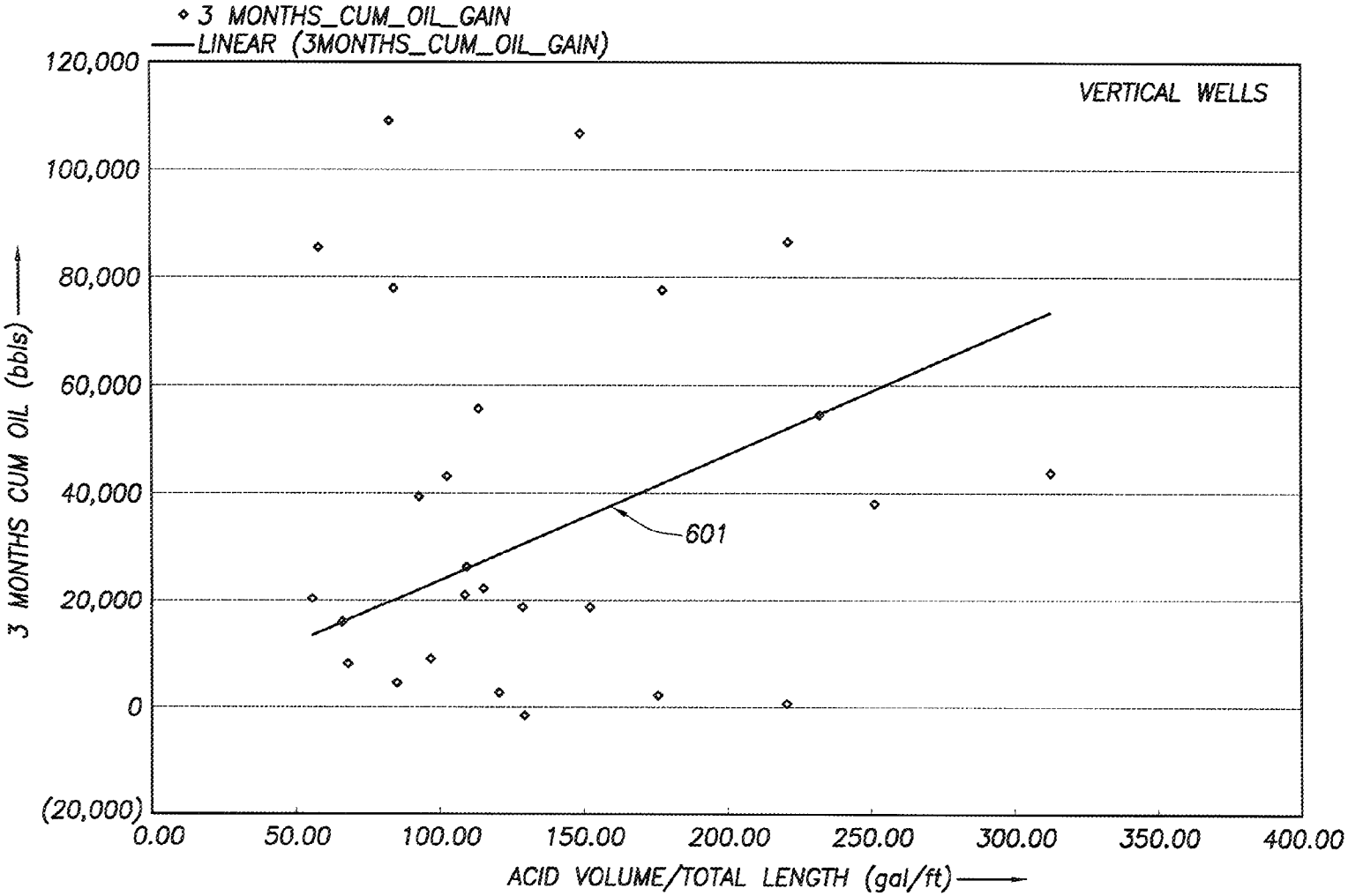

FIGS. 6-7 depict example data plots depicting the influence of acid volume over cumulative gain in acid fracturing treatments. The data plot in FIG. 6 is collected from a horizontal well. The data plot in FIG. 7 is collected from a vertical well. The horizontal axis represents acid volume used in acid fracturing treatments. The vertical axis represent cumulative gain of production output over a three month period as a result of the acid fracturing treatments. The various data points depicted in these data plots are based on historical data of various acid fracturing treatments performed with varying treatment parameters (e.g., treatment type such as first completion, re-stimulation, etc., acid volumes, fluids types, stages, rates, etc.), wellbore information parameters (e.g., deviation, perforations, lengths, etc.), and reservoir parameters (e.g., reservoir pressure, porosity, permeability, water saturation, etc.) as described above.

The lines (501) and (601) are statistical regression lines derived from these various data points in FIGS. 6 and 7, respectively. It can be seen that deviation of data points from the regression lines are random and significant. These deviations are effects of the varying parameters enumerated above and may exhibit different patterns for the horizontal and vertical wells. These deviations indicate that the output parameter production cannot be simply described by a combination of the two input parameters deviation and acid volume per length. More parameters need to be mapped.

As described above, these large amount of data and parameters can not be analyzed through simple linear relationships since the data and parameters form an N dimensional space, N being the number of parameters. In one example, this large amount of historical data and parameters may be modeled using mathematical model such as an artificial neural network. The mathematical model may be adaptive in that parameters of the mathematical model may be adjusted and validated during a training phase before being applied to predict new output results from combination of inputs parameter values not found in the historical data. One example artificial neural network includes the self organizing maps, which can be used to visualize a low dimensional representation of historical data used in the training phase of an artificial neural network.

Figure 8:
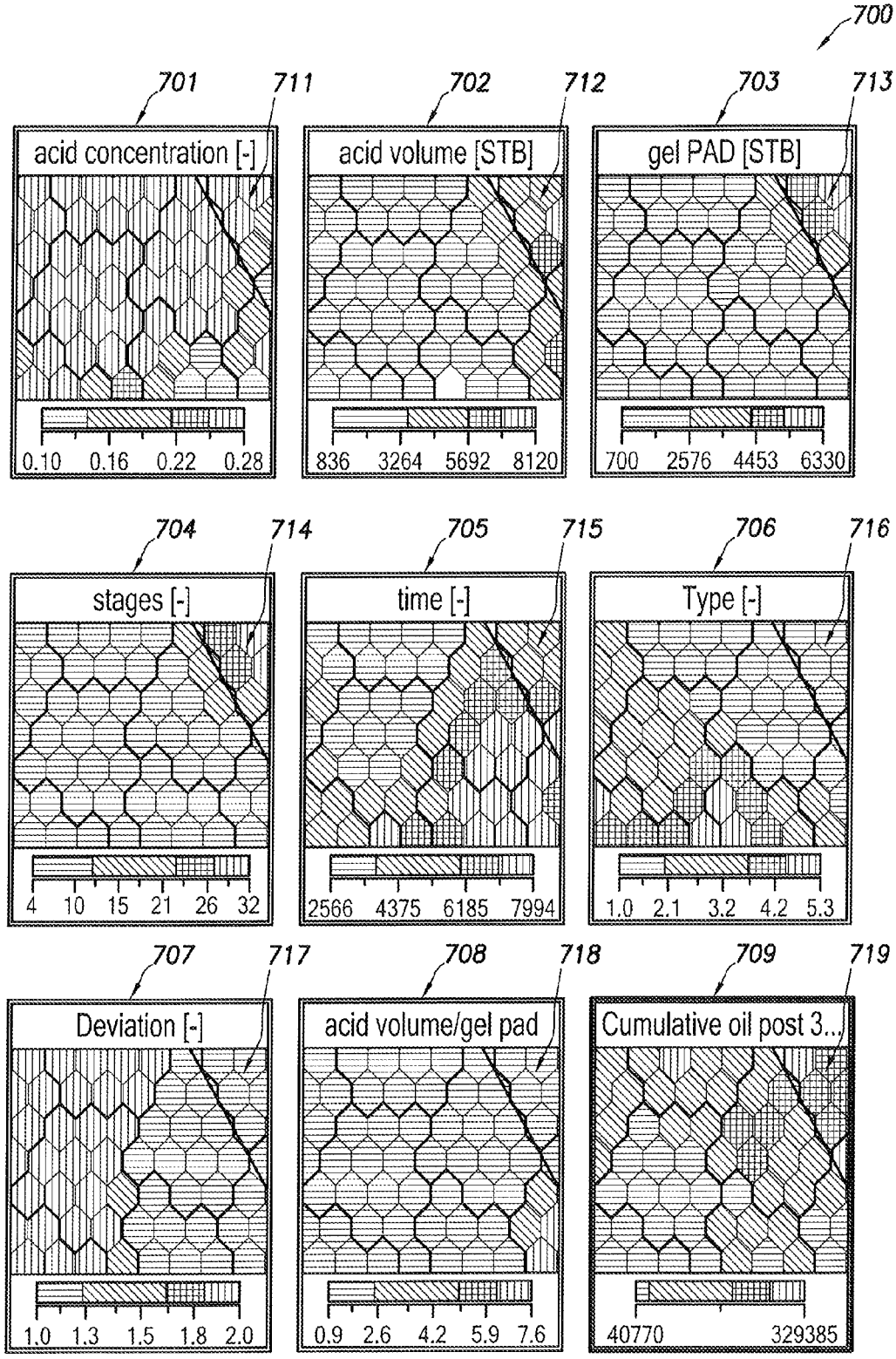
FIGS. 8-9 depict the use of self organizing maps in analyzing historical data of acid fracturing treatments in accordance with one or more embodiments.
Figure 9:
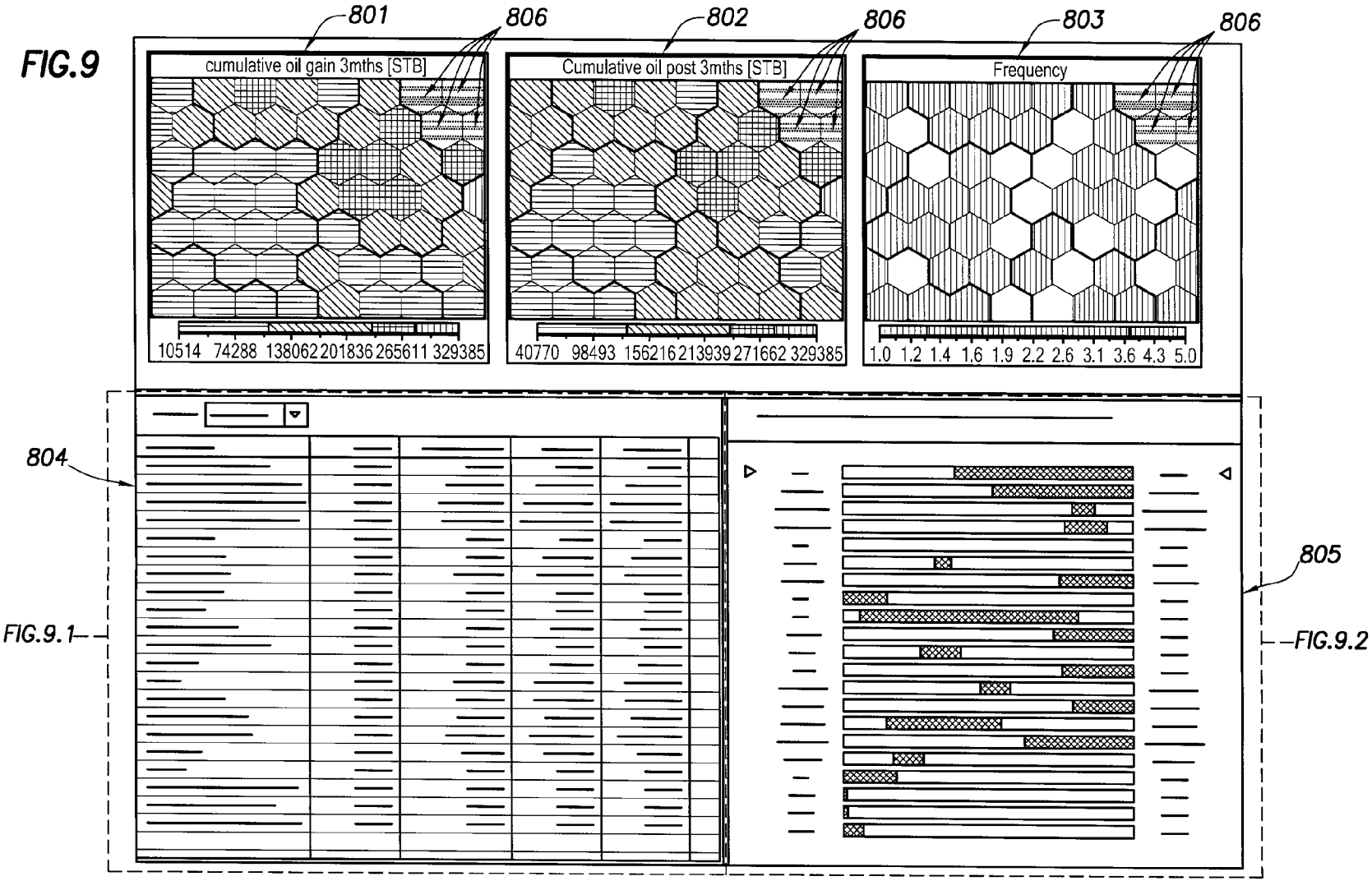

FIGS. 8-9 depict the use of self organizing maps of an artificial neural network in analyzing historical data of acid fracturing treatments. The large amount of historical data of acid fracturing treatments (e.g., corresponding to data points depicted in FIGS. 6 and 7 above) may be fed to the artificial neural network as training vectors in the training phase. Each of these training vectors may be composed of various parameters associated with the acid fracturing treatments considered in the historical data, such as treatment parameters (e.g., treatment type such as first completion, re-stimulation, etc., acid volumes, fluids types, stages, rates, etc.), wellbore information parameters (e.g., deviation, perforations, lengths, etc.), reservoir parameters (e.g., reservoir pressure, porosity, permeability, water saturation, etc.), and production output (e.g., cumulative oil post treatment, re-stimulation ratio, etc.).

As depicted in FIG. 8, self organizing maps (701-709) are generated from the training phase using historical data of acid fracturing treatments, for example the historical data depicted in FIGS. 6 and 7 above. Each self organizing map is generated with respect to a specific parameter. For example, self organizing map (SOM) (701) is generated with respect to the parameter "acid concentration" ranging from 0.10 to 0.28 (or 10% to 28%). Similarly, SOMs (702-709) are generated with respect to parameters "acid volume" ranging from 830 to 8120, "gel PAD" ranging from 700 to 6330, "stages" ranging from 4 to 32, "time" ranging from 2566 to 7994, "type" ranging from 1.0 to 4.3, "deviation" ranging from 1.0 to 2.0, "acid volume/gel PAD ratio" ranging from 0.9 to 7.6, and "cumulative oil post 3 months" ranging from 40770 to 329385, respectively. Although nine SOMs are depicted in FIG. 8, there may be additional SOMs not depicted. In other examples, there may be more or less number of SOMs.

In each of the SOMs, each hexagonal element represents historical data of a set of one or more treatments. The color of the hexagonal element represents the corresponding value of the specific parameter associated with the SOM. Through the training phase, multiple hexagonal elements are further clustered into regions bound by the solid black boundaries based on similarity of corresponding data. The similarity is measured based on certain configuration parameters of the training phase. A hexagonal element representing a particular set of one or more acid fracturing treatments is located at the same position in each of the SOMs (701-709).

A cluster of hexagonal elements (719) can be identified in SOM (709) that represent consistently high cumulative oil production over a three month period subsequent to corresponding acid fracturing treatments. Additional parameters of these corresponding acid fracturing treatments represented by the cluster (719) may be seen in clusters (711-718) in the SOMs (701-708), respectively. It can be seen that hexagonal elements in clusters (702), (715), (716), (717), and (718) exhibit consistent color in SOMs (701-708) indicating the represented parameters "acid volume", "time", "type", "deviation", and "acid volume/gel pad ratio" are correlated with the consistently high cumulative oil production identified in cluster (719) of SOM (709). Accordingly, the parameters "acid volume", "time", "type", "deviation", and "acid volume/gel pad ratio" are identified as key inputs to the data-driven model that can be used to model the behavior of the acid fracturing treatment operation of the oilfield.

FIG. 9 depicts selecting a subset of acid fracturing treatments for viewing in tabular format (804) and bar chart format (805). Here, four hexagonal elements (806) are selected and depicted in SOMs (801)-(803) with semi-transparent shading. The SOM (802) is substantially the same as SOM (709) of FIG. 8. The maximum, minimum, mean and standard deviation of historical data collected from the acid fracturing treatments associated with the four hexagonal elements (806) are depicted in tabular format (804) and bar chart format (805). Portions of FIG. 9 are expanded as FIGS. 9.1 and 9.2 for illustration purpose to show more details in tabular format (804) and bar chart format (805), respectively. The parameters include "acid concentration", "acid or inhibitor volume", "cumulative oil gain 3 months", "cumulative oil post 3 months", "deviation", "diverter", "gel PAD", "job number", "location", "maximum rate", "rate per perforation", "stages", "time", "total length", "total thickness", "total volume", "totperfs", "type", "years since completion", "years since last-job", and "acid volume gel pad ratio". Correlation between parameters may be identified based on standard deviations. For example, the four hexagonal elements (806) are selected based on consistently high oil production and gain indicated by the high value and low standard deviation of the parameters "cumulative oil gain 3 months" and "cumulative oil post 3 months". It can be seen that parameters "diviters", "rate per perforation", and "totperfs" are depicted with low standard deviations in the bar chart format. Therefore, these parameters may be correlated to the oil production and/or cumulative gain.

The methods of FIG. 8 and/or 12 may be applied in many oilfield applications. For example, historical data from many wellsites may be analyzed to select a candidate wellsite most productive from acid fracturing treatment. In another example, best practice procedures for acid fracturing treatments may be developed. In one or more embodiments of evaluation of acid fracturing treatments, historical data may be collected from a series of experimental acid fracturing treatments performed at a specific wellsite and the efficacy of these treatments may be ranked in performance (e.g., cumulative oil production) based on the methods of FIG. 8 and/or 12. In one or more embodiments, the best practice procedure may include at least a portion of the performance ranking. In one or more embodiments, the candidate wellsite may be identified and the best practice procedure may be established using a neural network such as the SOMs described with respect to FIGS. 8 and/or 12 as a data driven model to model the performance of the experimental acid fracturing treatments. More specifically, the data driven model uses key parameters described with respect to FIG. 8 and/or 12 as input parameters.

Figure 10:
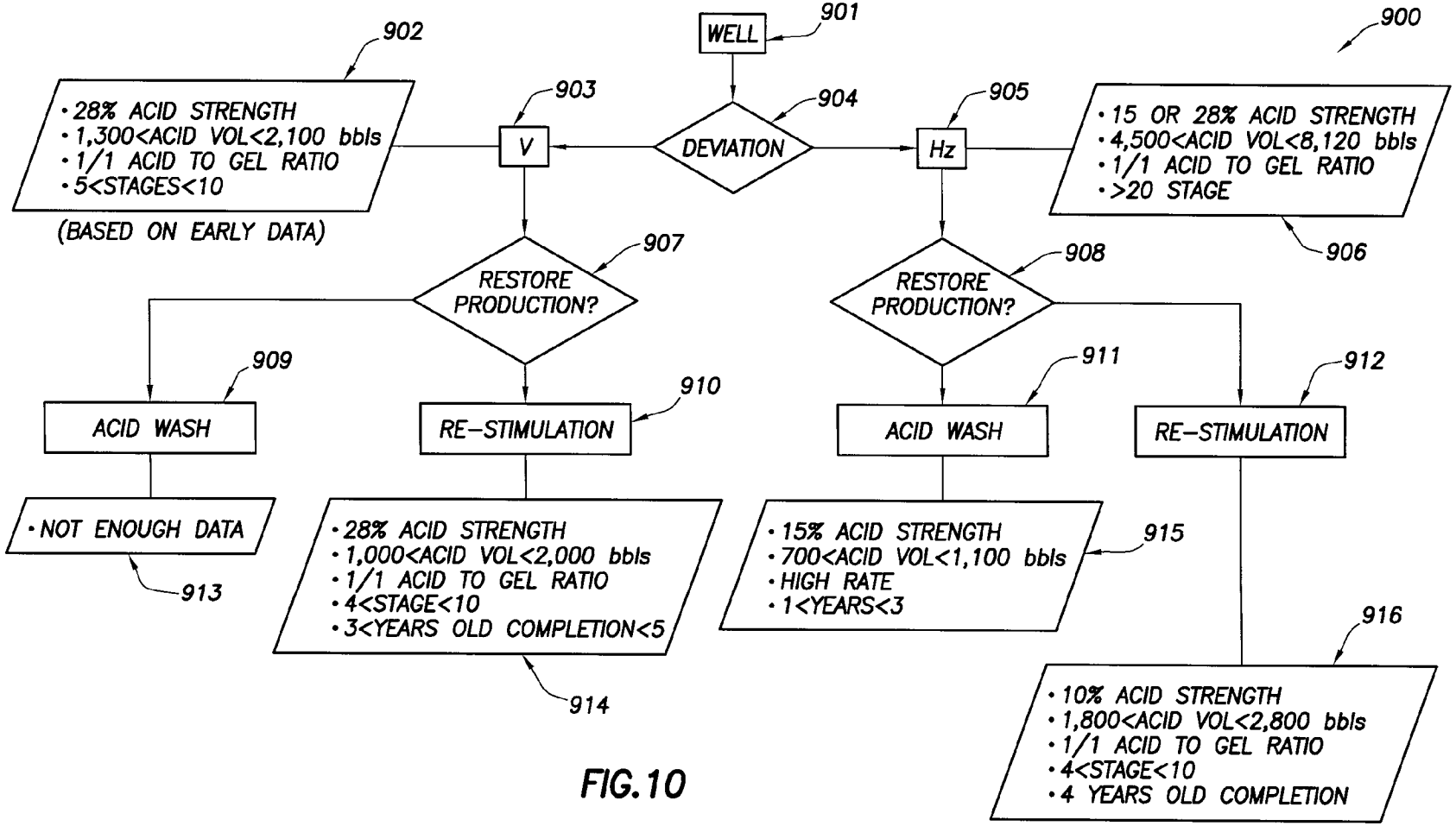
FIG. 10 depicts an example best practice procedure of acid fracturing treatment in accordance with one or more embodiments.

FIG. 10 depicts an example best practice procedure (900) of acid fracturing treatment. When a well (901) is being considered for treatment, the direction of the wellbore (i.e., deviation) (904) may determine which branch of the procedure tree (900) to follow. As described above in FIGS. 8 and 9, various key parameters identified using the SOM may be evaluated as pertaining to this well. For example, proper values of the "acid volume", "time", "type", "deviation", and "acid volume/gel pad ratio" are determined for achieving the production goal. The prescriptions for acid fracturing treatment may be obtained by using the data driven model, for example using the mapping mode of the SOMs (701-709). If the well is a horizontal well (905), a general prescription of the treatment parameter (906) may be applied during initial stimulation as a new well. Later one in the production cycle, the condition of the treatment may further be determined as to whether it is for restoring production (908), in which case re-stimulation program (912) may be performed with the treatment parameter prescription (916). If the treatment is not for restoring production, then acid wash (911) may be prescribed with the treatment parameter prescription (915). If the well is a vertical well (903), a general prescription of the treatment parameter (902) may be applied during initial stimulation as a new well. Later in the production cycle, the condition of the treatment may further be determined as to whether it is for restoring production (907), in which case re-stimulation program (910) may be performed with the treatment parameter prescription (914). If the treatment is not for restoring production, then acid wash (909) may be prescribed with the treatment parameter prescription (913). In the example depicted in FIG. 10, certain parameters such as "deviation" (horizontal or vertical) and "type" (initial stimulation, re-stimulation, or acid wash) are used to direct branching of the best practice procedure tree while other parameters such as the "acid concentration", "acid volume", "acid volume/gel pad ratio", and "stages" are used in forming the treatment prescriptions. In other examples, the same SOMs may be used to organize the best practice procedure trees differently.

FIG. 11 depicts a flow chart of a method in accordance with aspects of evaluation of acid fracturing treatments in an oilfield. Initially, large amount of historical data (e.g., as depicted in FIG. 6 or 10 above) of acid fracturing treatments of the oilfield are obtained (Element 1001). Then a neural network such as SOMs (e.g., SOMs as depicted in FIG. 8 or 12 above) are generated based on these historical data (Element 1003). Based on the neural network such as these SOMs, one or more stimulation parameters (e.g., "acid volume", "time", "type", "deviation", and "acid volume/gel pad ratio", or other parameters) may be identified as key parameters (or governing parameters) correlated with optimal performance of the acid fracturing treatments of the oilfield (Element 1005). Using the neural network, such as the SOMs, as a data driven model with these key parameters to model the performance of acid fracturing treatments, a best practice procedure may be determined for performing acid fracturing operation for the oilfield (Element 1007). Furthermore, a candidate well may be identified from the oilfield for performing an acid fracturing treatment to achieve productive results (Element 1009).

The evaluation of acid fracturing treatments may be implemented on virtually any type of computer regardless of the platform being used. The computer system may be connected to a local area network (LAN) or a wide area network (e.g., the Internet) via a network interface connection. Those skilled in the art will appreciate that these input and output means may take other forms.

Further, those skilled in the art will appreciate that one or more elements of the aforementioned computer system may be located at a remote location and connected to the other elements over a network. Further, one or more embodiments may be implemented on a distributed system having a plurality of nodes, where portions of the implementation may be located on a different node within the distributed system. In one embodiment, the node corresponds to a computer system. Alternatively, the node may correspond to a processor with associated physical memory. The node may alternatively correspond to a processor with shared memory and/or resources. Further, software instructions to perform aspects of evaluation of acid fracturing treatments may be stored on a compact disc (CD), a diskette, a tape, a file, or any other computer readable storage device.

While the invention has been described with respect to a limited number of aspects, those skilled in the art, having benefit of this disclosure, will appreciate that other aspects can be devised which do not depart from the scope of the invention as disclosed herein. Accordingly, the scope of the invention should be limited only by the attached claims.

What is claimed is:

1. A method for performing acid fracturing operations of an oilfield, comprising:

obtaining a plurality of historical data of acid fracturing treatments of the oilfield, wherein the plurality of historical data comprises a plurality of treatment parameters, a plurality of wellbore information parameters, and a measure of production output subsequent to historical acid fracturing operations;

generating, by a computer processor, a neural network based on the plurality of historical data;

identifying, in the neural network, stimulation parameters associated with optimal performance of the acid fracturing treatments, wherein the simulation parameters comprise a treatment parameter identified from the plurality of treatment parameters and a wellbore information parameter identified from the plurality of wellbore information parameters;

establishing, by the computer processor, a procedure for performing the acid fracturing operations based on the stimulation parameters, comprising:

determining a branching condition of the procedure based on the wellbore information parameter;

extracting, from the historical data, a selected value of the treatment parameter that is associated with the optimal performance of the acid fracturing treatments, wherein the selected value is dependent on the branching condition;

determining a prescription of acid fracturing treatment based on the selected value of the treatment parameter; and storing the procedure in a repository.

2. The method of claim 1, wherein the acid fracturing treatments comprise a plurality of experimental treatments performed for a wellsite of the oilfield, and wherein the procedure comprises performance ranking of at least a portion of the plurality of experimental treatments for the wellsite.

3. The method of claim 2, wherein the procedure is established using the neural network as a data driven model to model performance of the plurality of experimental treatments, wherein the data driven model is validated based on the plurality of historical data.

4. The method of claim 1, further comprising:

identifying, based on the neural network, a candidate wellsite for performing the acid fracturing operations.

5. The method of claim 4, further comprising:

performing the acid fracturing operations at the candidate wellsite based on the procedure.

6. The method of claim 1, wherein the procedure is established separately for a horizontal well and a vertical well.

7. The method of claim 1, wherein the plurality of treatment parameters comprise at least one selected from a group consisting of an acid concentration parameter, an acid volume parameter, a gel pad parameter, and a time parameter, wherein the plurality of wellbore information parameters comprise at least one selected from a group consisting of a wellbore deviation parameter and wellbore type parameter, and wherein the neural network comprises a plurality of self organizing maps.

8. A non-transitory computer readable medium, embodying instructions executable by a computer to perform acid fracturing operations of an oilfield, the instructions comprising functionality for:

obtaining a plurality of historical data of acid fracturing treatments of the oilfield, wherein the plurality of historical data comprises a plurality of treatment parameters, a plurality of wellbore information parameters, and a measure of production output subsequent to historical acid fracturing operations;

generating a plurality of self organizing maps based on the plurality of historical data;

identifying stimulation parameters associated with optimal performance of the acid fracturing treatments from the plurality of self organizing maps, wherein the simulation parameters comprise a treatment parameter identified from the plurality of treatment parameters and a wellbore information parameter identified from the plurality of wellbore information parameters;

establishing a procedure for performing the acid fracturing operations based on the stimulation parameters, comprising:

determining a branching condition of the procedure based on the wellbore information parameter;

extracting, from the historical data, a selected value of the treatment parameter that is associated with the optimal performance of the acid fracturing treatments, wherein the selected value is dependent on the branching condition;

determining a prescription of acid fracturing treatment based on the selected value of the treatment parameter; and identifying, based on the plurality of self organizing maps, a candidate wellsite for performing the acid fracturing operations based on the stimulation parameter.

9. The computer readable medium of claim 8, wherein the acid fracturing treatments comprise a plurality of experimental treatments performed for a wellsite of the oilfield, wherein the candidate is identified using the plurality of self organizing maps as a data driven model to model performance of the plurality of experimental treatments, and wherein the data driven model is validated based on the plurality of historical data.

10. The computer readable medium of claim 8, wherein the procedure comprises performance ranking of at least a portion of the plurality of experimental treatments for the wellsite.

11. The computer readable medium of claim 8, wherein the plurality of treatment parameters comprise at least one selected from a group consisting of an acid concentration parameter, an acid volume parameter, a gel pad parameter, and a time parameter, wherein the plurality of wellbore information parameters comprise at least one selected from a group consisting of a wellbore deviation parameter and wellbore type parameter, wherein the procedure is established using the plurality of self organizing maps as a data driven model to model performance of the plurality of experimental treatments, and wherein the data driven model is validated based on the plurality of historical data.

12. The computer readable medium of claim 10, wherein the procedure is established separately for a horizontal well and a vertical well.

13. The computer readable medium of claim 10, further comprising:

performing the acid fracturing operations at the candidate wellsite based on the procedure.

14. A computer system for performing acid fracturing operations of an oilfield, comprising:

a repository, a processor; and memory comprising software instructions to execute on the processor to:

obtain a plurality of historical data of acid fracturing treatments of the oilfield, wherein the plurality of historical data is stored in the repository and comprises a plurality of treatment parameters, a plurality of wellbore information parameters, and a measure of production output subsequent to historical acid fracturing operations;

generate a plurality of self organizing maps based on the plurality of historical data;

identify stimulation parameters associated with optimal performance of the acid fracturing treatments from the plurality of self organizing maps, wherein the simulation parameters comprise a treatment parameter identified from the plurality of treatment parameters and a wellbore information parameter identified from the plurality of wellbore information parameters;

establish a procedure for performing the acid fracturing operations based on the stimulation parameter, comprising:

determining a branching condition of the procedure based on the wellbore information parameter;

extracting, from the historical data, a selected value of the treatment parameter that is associated with the optimal performance of the acid fracturing treatments, wherein the selected value is dependent on the branching condition, and determining a prescription of acid fracturing treatment based on the selected value of the treatment parameter.

15. The computer system of claim 14, wherein the acid fracturing treatments comprise a plurality of experimental treatments performed for a wellsite of the oilfield, and wherein the procedure comprises performance ranking of at least a portion of the plurality of experimental treatments for the wellsite.

16. The computer system of claim 15, wherein the procedure is established using the plurality of self organizing maps as a data driven model to model performance of the plurality of experimental treatments, wherein the data driven model is validated based on the plurality of historical data.

17. The computer system of claim 14, wherein the procedure is established separately for a horizontal well and a vertical well.

18. The computer system of claim 15, wherein memory further comprises software instructions to execute on the processor to:

identify a candidate wellsite, based on the plurality of self organizing maps, for performing the acid fracturing operations based on the stimulation parameter.

19. The computer system of claim 18, wherein the plurality of treatment parameters comprise at least one selected from a group consisting of an acid concentration parameter, an acid volume parameter, a gel pad parameter, and a time parameter, wherein the plurality of wellbore information parameters comprise at least one selected from a group consisting of a wellbore deviation parameter and wellbore type parameter, wherein the candidate is identified using the plurality of self organizing maps as a data driven model to model performance of the plurality of experimental treatments, and wherein the data driven model is validated based on the plurality of historical data.

* * * * *